US006024057A

United States Patent [19]

Betchaku

[11] Patent Number: 6,024,057

[45] Date of Patent: Feb. 15, 2000

[54] ENGINE CYLINDER HEAD

[75] Inventor: Shigehisa Betchaku, Machida, Japan

[73] Assignee: Nissan Motor Co., Ltd., Kanagawa, Japan

[21] Appl. No.: 09/176,414

[22] Filed: Oct. 21, 1998

[30] Foreign Application Priority Data

Oct. 21, 1997 [JP] Japan ..... 9-288130

[51] Int. Cl.[7] ..... F02F 1/38

[52] U.S. Cl. ..... 123/41.82 R; 123/193.5; 123/193.3

[58] Field of Search ..... 123/193.3, 193.5, 123/41.72, 41.82 R

[56] References Cited

U.S. PATENT DOCUMENTS

| | | | |
|---|---|---|---|
| 4,860,700 | 8/1989 | Smith | 123/41.31 |
| 4,889,079 | 12/1989 | Takeda et al. | 123/41.82 R |
| 5,743,218 | 4/1998 | Aupperle et al. | 123/41.82 R |

FOREIGN PATENT DOCUMENTS 6-288295 10/1994 Japan .

*Primary Examiner*—Noah P. Kamen
*Assistant Examiner*—Hai Huynh
*Attorney, Agent, or Firm*—McDermott, Will & Emery

[57] ABSTRACT

A pair of intake ports and a pair of exhaust ports corresponding to respective cylinders in a multi-cylinder engine are formed in a cylinder head. A water jacket is formed which recirculates cooling water around the ports in the cylinder head. A side wall of the intake port of one cylinder and a side wall of the exhaust port of another cylinder adjacent to the first cylinder, are connected by a rib formed on the base surface of the water jacket. The rib cuts transversely across a straight line joining the centers of the two cylinders. In this way, the rigidity of the cylinder head is increased, seal tightness of a join between the cylinder head and a cylinder block is improved, and the cooling water in the water jacket is recirculated around the exhaust ports which bear high thermal load.

4 Claims, 2 Drawing Sheets

ENGINE CYLINDER HEAD

The contents of Tokugan Hei 9-288130, with a filing date of Oct. 21, 1997 in Japan, are hereby incorporated by reference.

FIELD OF THE INVENTION

This invention relates to a cylinder head of an engine for a vehicle.

BACKGROUND OF THE INVENTION

A cylinder head of a water-cooled multi-cylinder diesel engine wherein a fuel injection nozzle is arranged effectively in the center of each cylinder, and two intake ports and two exhaust ports are formed around the nozzle, are disclosed in Tokkai Hei 6-288295 published by the Japanese Patent Office in 1994. Each intake port is equipped with an intake valve and each exhaust port is equipped with an exhaust valve. Bosses of cylinder head bolts which join the cylinder head and a cylinder block are formed around each cylinder. One intake valve and one exhaust valve are each arranged on both sides of a center line joining the centers of the cylinders, and neighboring intake ports and exhaust ports are joined by ribs.

The cylinder head and cylinder block are joined via a gasket. As maximum combustion pressure power is high for a diesel engine, airtightness of this joint part is particularly important. A large number of cylinder head bolts are therefore used to firmly join the cylinder head and cylinder block. In this engine, the cylinders are arranged parallel to each other along the center line. In order to make the engine compact, the space between the cylinders is set to be minimum and there is no room to dispose the cylinder head bolt near the center line between the cylinders.

As a result, the cylinder head bolts are arranged at points which are largely offset from the center line, the tightening power of the cylinder head bolts does not easily reach this part between the cylinders, and the sealing ability of this part is generally lower than in other parts of the cylinder head.

Further, the exhaust ports are heated by the exhaust gas, and hence the thermal load on the exhaust ports is larger than on the intake ports.

It is therefore particularly necessary to cool exhaust ports, but it is not easy to lead cooling water circulating between two cylinders into an area enclosed by two exhaust ports.

SUMMARY OF THE INVENTION

It is therefore an object of this invention to make the tightening power of the cylinder head bolts extend fully to an area between cylinders of a cylinder head.

It is a further object of this invention to supply sufficient cooling water for cooling the exhaust ports.

In order to achieve the above objects, a cylinder head for a multi-cylinder engine according to this invention comprises a first intake port, a second intake port, a first exhaust port, and a second exhaust port for each cylinder. The cylinder head further comprises a water jacket formed for recirculating cooling water surrounding the intake and exhaust ports. The cylinder head further comprises a rib connecting a side wall of the first intake port of a first cylinder and a side wall of the second exhaust port of a second cylinder adjacent to the first cylinder. The water jacket has a base and the rib is formed on the base of the water jacket so as to transversely cut an axis joining the centers of the cylinders.

It is preferable that, corresponding to each of the first and second cylinders, the first intake port and the first exhaust port are arranged on a upstream side of the axis with respect to cooling water flow, the second intake port and the second exhaust port are arranged on a downstream side of the axis with respect to cooling water flow, the rib joins to the side wall of the first intake port of the first cylinder at the upstream side of the axis, and the rib joins to the side wall of the second exhaust port of the second cylinder at the downstream side of the axis.

When the engine comprises a cylinder block joined to the cylinder head via cylinder head bolts, it is preferable that the cylinder head comprises plural bosses through which the cylinder head bolts are passed, the intake ports are arranged downstream of the exhaust ports corresponding to the same cylinder from the viewpoint of cooling water flow, a first cooling water passage forming part of the water jacket is formed between the side wall of the first intake port and the boss adjacent thereto, a second cooling water passage forming part of the water jacket is formed between the side wall of the second intake port of the same cylinder and the boss adjacent thereto, and the cross -sectional area of the first cooling water passage is set greater than the cross-sectional area of the second cooling water passage.

It is further preferable that a tangential intake passage connected to the first intake port and a helical intake passage connected to the second intake port are formed in the cylinder head.

The details as well as other features and advantages of this invention are set forth in the remainder of the specification and are shown in the accompanying drawings.

DESCRIPTION OF THE PREFERRED EMBODIMENTS

Figure 1:
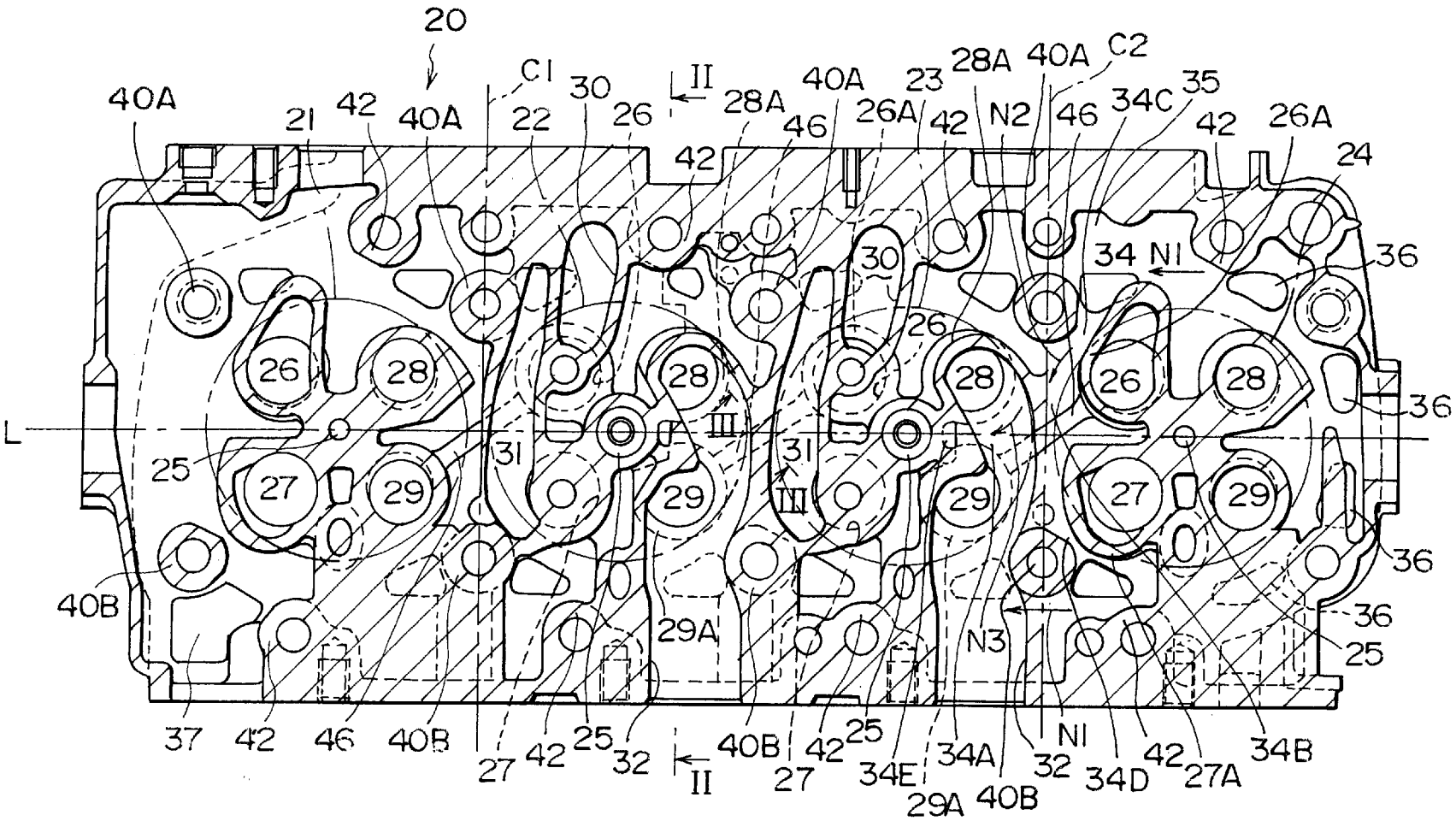
FIG. 1 is a horizontal sectional view of a cylinder head of an engine according to this invention.

Referring to FIG. 1 of the drawings, a cylinder head 20 of a water-cooled diesel engine for a vehicle is provided with four cylinders 21–24, and an attachment hole 25 of a fuel injection nozzle is formed in the center of each cylinder.

In this figure, an area enclosed between lines C1 and C2 shows a horizontal section of different height from the areas on both sides. The latter shows a section in the vicinity of the base surface of the cylinder head 20, and the former shows a horizontal section at a higher position.

The cylinder head 20 is cast in aluminum alloy. A first intake port 26, second intake port 27, first exhaust port 28 and second exhaust port 29 are formed in every cylinder in the cylinder head 20. The first intake port 26 and the first exhaust port 28 are arranged on one side of an axis L which joins the centers of the cylinders. The second intake port 27 and the second exhaust port 29 are arranged on the other side of the axis L. An intake valve is provided in each intake port, and an exhaust valve is provided in each exhaust port.

The intake ports 26, 27 are formed with a different shape in order to reinforce swirl in the combustion chamber. In other words, the first intake port 26 situated above the line L of FIG. 1 comprises a tangential intake passage 30, and the second intake port 27 situated below the line comprises a helical intake passage 31.

Figure 2:
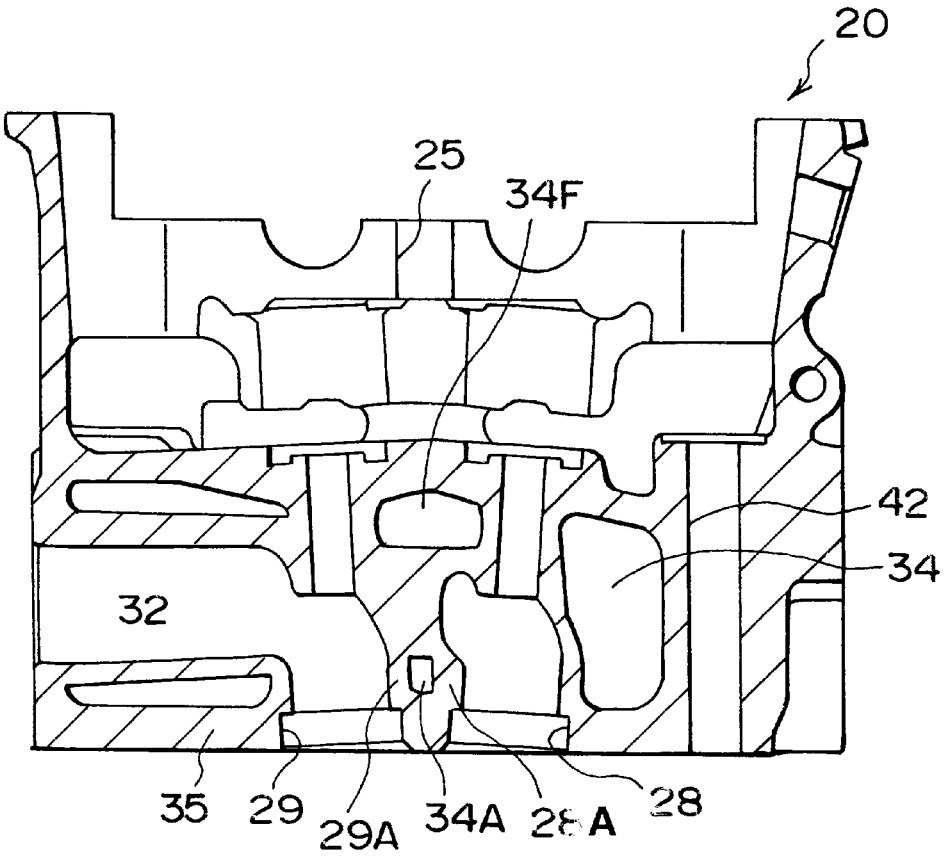
FIG. 2 is a sectional view of the cylinder head taken along a line II—II of FIG. 1.

These passages 30 and 31 both open on the side of the cylinder head 20 in the upper part of the figure. The exhaust ports 28, 29 both open on the side of the cylinder head 20 in the lower part of the figure. The exhaust ports 28, 29 are both connected to an exhaust passage 32 shown in FIG. 2 formed in the cylinder head 20. This exhaust passage opens onto the opposite side of the cylinder head 20 to the aforesaid passages 30, 31.

A water jacket 34 is formed inside the cylinder head 20. The base surface of the water jacket 34 is partitioned by a lower deck 35. Plural connecting holes 36 are formed in the lower deck 35 in the vicinity of the cylinder 24 on the right-hand side of FIG. 1.

The connecting holes 36 are connected to identical connecting holes formed in the cylinder block, not shown, and cooling water pressurized from a water pump is introduced into the water jacket 34 in the cylinder head 20 via these connecting holes 36.

In the water jacket 34, cooling water flows from right to left of FIG. 1 as shown by the arrow N1, and flows out into a radiator, not shown, from a port 37 formed in the vicinity of the cylinder 21.

The cylinder head 20 is tightened to the cylinder block via a gasket by a plurality of cylinder head bolts. Bosses 40A, 40B are formed for this purpose around the cylinders. To simplify the description, the bosses situated above the L axis in FIG. 1 are referred to as 40A and the bosses situated below the L axis in FIG. 1 are referred to as 40B.

As a result, in all cylinders, the bosses 40A, 40B are formed at approximately equal distances from the center and approximately equal angular intervals at four positions, which means that the bosses 40A, 40B are provided at a total of ten positions for four cylinders.

Four each of similar bosses 42 are formed near the two sides of the cylinder head 20 at a total of eight positions.

In the L axis direction, the position of the boss 42 is in the vicinity of a point intermediate between two adjacent bosses 40.

As maximum combustion pressure is higher in a diesel engine than in a gasoline engine, airtightness is important around each cylinder on the join surface between the cylinder head 20 and cylinder block. In this cylinder head 20, by providing a boss as above in 18 positions as described above, seal pressure is maintained between the cylinder head 20 and cylinder block via a gasket.

Further, in this cylinder head 20, a rib 46 joining a wall 26A of the cylinder head 20 which partitions the first intake port 26 of the cylinder 23 and a wall 29A of the cylinder head 20 which partitions the second exhaust port 29 of a cylinder 22 adjacent to a cylinder 23 on the downstream side from the viewpoint of cooling water flow, is formed by the lower deck 35 so as to cut diagonally across the L axis.

Regarding adjacent parts at two other positions which are similarly arranged, i.e. the adjacent parts of the cylinder 22 and cylinder 21, and the cylinder 24 and cylinder 23, the wall 26A of the first intake port 26 and the wall 29A of the second exhaust port 29 of the adjacent cylinder on the downstream side are connected by the rib 46.

Figure 3:
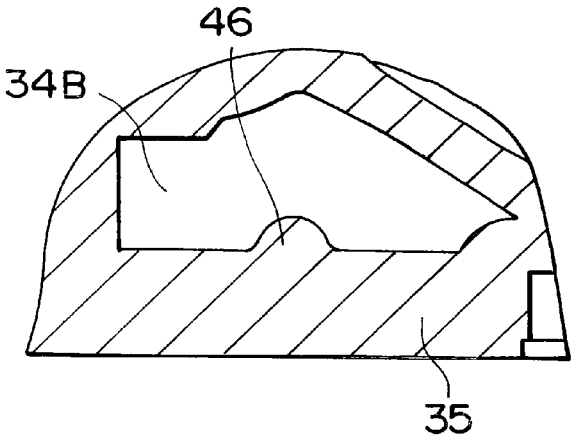
FIG. 3 is a sectional view of essential parts of the cylinder head taken along a line III—III of FIG. 1.

Next, this rib 46 will be described referring to FIG. 3. FIG. 3 shows a section of the cylinder head 20 cut out along the line III—III of FIG. 1. The rib 46 is formed when the cylinder head 20 is cast, and it extends upwards from the lower deck 35 forming the base of the cylinder head 20. A space 34B above the lower deck 35 constitutes a cooling water passage of the water jacket 34.

Due to this rib 46, the tightening force of the head bolt acting on the wall 26A and wall 29A via the bosses 40A and 40B is effectively transmitted to the lower deck 35 via the rib 46.

Therefore, deformation of the lower deck 35 by the combustion pressure in the cylinder is suppressed. As a result, a tight fit of the base surface of the cylinder head 20 and the top face of the cylinder block is always maintained via the gasket, and the seal properties of this part are improved.

The rib 46 functions as a guide for guiding cooling water in the water jacket 34 into a space 34A formed by the first exhaust port 28 and the second exhaust port 29.

Cooling water in the water jacket 34 flows in the direction of the arrow N1 as shown in FIG. 1. A part of this flow passes through a space 34C between the boss 40A and wall 26A, and a space 34B surrounded by the first intake port 26, second intake port 27, and first exhaust port 28 and second exhaust port 29 of the adjacent cylinder.

In this embodiment, a flowpath cross-sectional area of the space 34C is set larger than a flowpath cross-sectional area of a space 34D situated between the surface 27A of the second intake port 27 and the boss 40B.

Since the second intake port 27 is connected to the helical intake passage 31, which has a purpose to improve the combustion of the engine, their join part is bulged outward. The above arrangement is therefore easily realized without additional arrangement with respect to the shape of the second intake port 27.

As a result, flow of cooling water from the space 34C to the space 34B is promoted, as shown by the arrow N2 in the diagram. The rib 46 guides this flow as shown by the arrow N3 in the diagram, and guides it to the space 34A enclosed by the exhaust ports 28, 29 which have a high thermal load. Cooling water led into the space 34A passes through a passage 34E formed in the up/down direction in the cylinder head 20, and into a passage 34F shown in FIG. 2.

By introducing a large amount of cooling water into the space 34A enclosed by the exhaust ports 28, 29 which have a high thermal load, the cylinder head 20 is prevented from overheating due to engine combustion, and the durability of the cylinder head 20 is improved.

In this embodiment, one exhaust port and one intake port were arranged on both sides of the L axis, but the invention may also be applied to an engine wherein two intake ports are arranged on one side of the L axis, and two exhaust ports are arranged on the opposite side.

This invention was applied to a diesel engine, but it may be applied also to a gasoline engine. In a gasoline engine, the boss 42 may be omitted as the combustion pressure is low.

The embodiments of this invention in which an exclusive property or privilege is claimed are defined as follows:

What is claimed:

1. A cylinder head for a multi-cylinder engine, comprising:

a first intake port, a second intake port, a first exhaust port, and a second exhaust port formed corresponding to each cylinder, a water jacket formed for recirculating cooling water surrounding said intake and exhaust ports, said water jacket having a base, and a rib connecting a side wall of said first intake port of a first cylinder and a side wall of said second exhaust port of a second cylinder adjacent to said first cylinder, said rib being formed on the base of said water jacket so as to transversely cut an axis joining the centers of said cylinders.

2. A cylinder head as defined in claim 1, wherein, corresponding to each of said first and second cylinders, said first intake port and said first exhaust port are arranged on a upstream side of said aids with respect to cooling water flow, said second intake port and said second exhaust port are arranged on a downstream side of said axis with respect to cooling water flow, said rib joins to the side wall of said first intake port of said first cylinder at the upstream side of said axis, and said rib joins to the side wall of said second exhaust port of said second cylinder at the downstream side of said axis.

3. A cylinder head as defined in claim 1, wherein said engine comprises a cylinder block joined to said cylinder head via cylinder head bolts, said cylinder head comprises plural bosses through which said cylinder head bolts are passed, said first and second intake ports are arranged downstream of said first and second exhaust ports corresponding to the same cylinder from the viewpoint of cooling water flow, a first cooling water passage forming part of said water jacket is formed between the side wall of said first intake port and the boss adjacent thereto, a second cooling water passage forming part of said water jacket is formed between the side wall of said second intake port of the same cylinder and the boss adjacent thereto, and the cross-sectional area of said first cooling water passage is set greater than the cross-sectional area of said second cooling water passage.

4. A cylinder head as defined in claim 3, wherein a tangential intake passage connected to said first intake port and a helical intake passage connected to said second intake port are formed in said cylinder head.

* * * * *